109-12 SR
8/7/84 OR 4,463,685

United States Patent [19]

Morel

[11] Patent Number: 4,463,685

[45] Date of Patent: Aug. 7, 1984

[54] PROTECTIVE DEVICE AGAINST AGGRESSIONS

[76] Inventor: Jacques Morel, 1 rue de la Montée des changes, Troyes F 10 000, France

[21] Appl. No.: 306,916

[22] PCT Filed: Jan. 23, 1981

[86] PCT No.: PCT/FR81/00007

§ 371 Date: Sep. 25, 1981

§ 102(e) Date: Sep. 25, 1981

[87] PCT Pub. No.: WO81/02180

PCT Pub. Date: Aug. 6, 1981

[30] Foreign Application Priority Data

Jan. 25, 1980 [FR] France ..... 80 01648

[51] Int. Cl.[3] ..... E06B 9/02

[52] U.S. Cl. ..... 109/12; 109/13; 109/15; 109/16

[58] Field of Search ..... 109/10, 11, 12, 13, 109/14, 15, 16, 17, 18, 19

[56] References Cited

U.S. PATENT DOCUMENTS

| | | | |
|---|---|---|---|
| 547,702 | 10/1895 | Wait | 109/17 |
| 602,741 | 4/1898 | Fry | 109/14 |
| 1,482,961 | 2/1926 | Banitt et al. | 109/12 |
| 1,572,091 | 2/1926 | Smith | 109/11 |
| 1,585,151 | 5/1926 | Johnston | 109/13 |
| 1,666,773 | 4/1928 | Clark | 109/17 |
| 1,675,166 | 6/1928 | Davidson | 109/15 |
| 1,863,680 | 6/1932 | Young et al. | 109/13 |
| 1,891,554 | 12/1932 | Robinson | 109/15 |

FOREIGN PATENT DOCUMENTS

| | | | |
|---|---|---|---|
| 1708459 | 9/1975 | Fed. Rep. of Germany | 109/12 |
| 2544978 | 4/1977 | Fed. Rep. of Germany | 109/11 |
| 1358330 | 7/1964 | France . | |
| 2449773 | 9/1980 | France | 109/17 |

*Primary Examiner*—Gene Mancene
*Assistant Examiner*—David I. Tarnoff
*Attorney, Agent, or Firm*—Larson and Taylor

[57] ABSTRACT

The invention relates to a protective device against aggression.

The protective device against aggression is designed to close the free space situated above the tray of a counter or cash-desk rapidly from below upwards.

The closing means comprise a tray movable upwards from a lowered position in which it is substantially horizontal to a raised vertical position blocking said space.

24 Claims, 12 Drawing Figures

Fig. 4
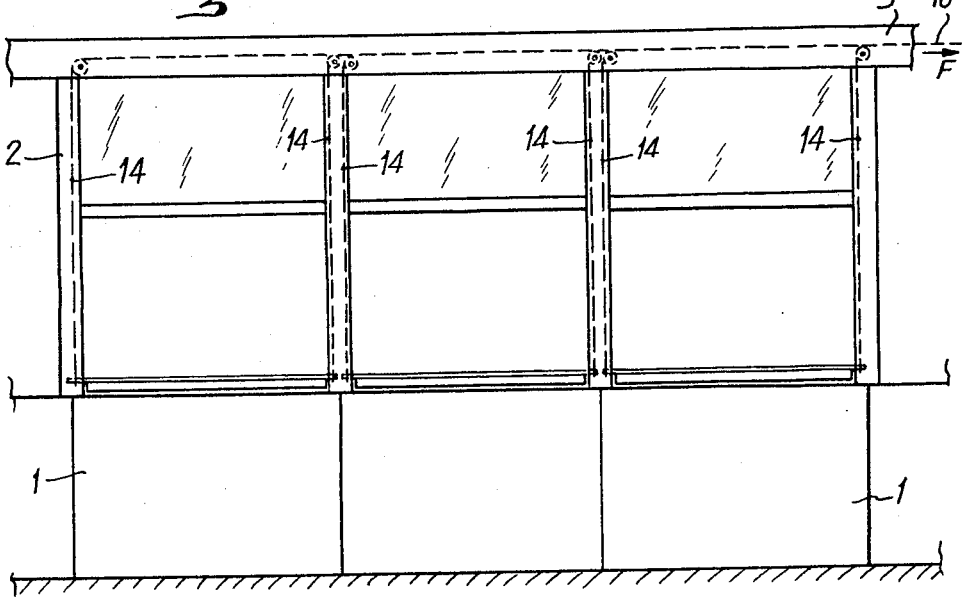
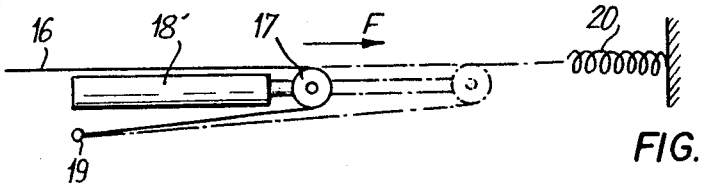
FIG. 5a
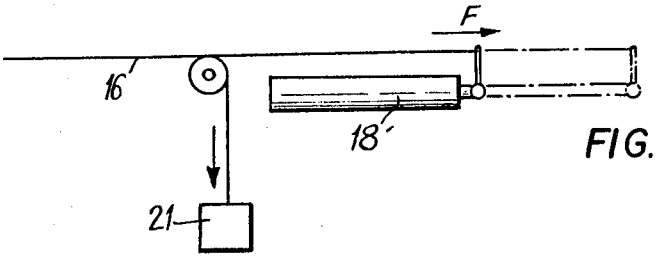
FIG. 5b
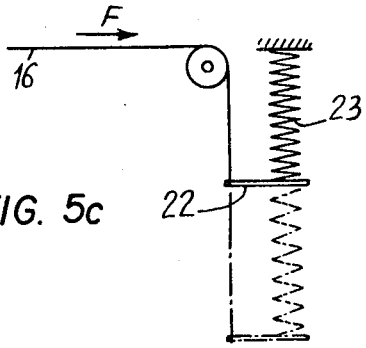
FIG. 5c
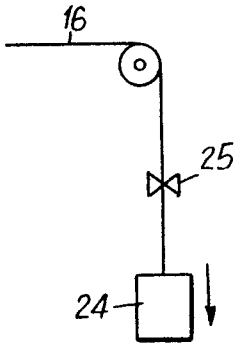
FIG. 5d

PROTECTIVE DEVICE AGAINST AGGRESSIONS

The present invention relates to a protective device against aggressions, of the type exhibiting the form of a counter or cash desk.

A certain number of types of protective devices against aggressions have already been proposed in order to assure the protection of cashier's booths, cash desks and counters and to prevent thefts and hold-ups. These devices are divided into two categories.

The first provides for interposing between the public and the employee, a wall which may or may not be transparent, permanently installed, permitting the passage of articles only through openings of small dimensions, capable in certain cases, of being rapidly closed. In certain cases the wall is replaced by a grill behind which is a system of bullet-proof plates, rapidly raisable, the grill for its part preventing passage across the counter. These devices have the drawback of creating a considerable distance between the public and the employee, which is an impediment to modern commercial methods.

To overcome this drawback, the second category covers devices exhibiting more or less the form of conventional cash desks or counters, that is to say having above the table of the counter or cash-desk a considerable free space which can be rapidly closed by a sliding plate, driven preferably with a vertical upward movement. In fact, a plate which, as has already been proposed, would be driven by a vertical downward movement would be particularly dangerous and this solution has generally been rejected.

In the presently known devices, the protective plate is concealed in the counter or cash desk and in the case of aggression is propelled upwards by suitable drive means to block the space situated above the cash desk.

One of these devices, described in French Pat. No. 2,242,735 has met with wide commercial success by reason of its particular qualities, notably by reason of the reduced risk of accident and of difficulty in preventing its operation.

Devices of this type have however the drawback of being relatively complex and of imposing particular requirements for their installation. In fact, the need to conceal the plate within the cash-desk or counter is a nuisance in a large number of cases and is generally incompatible with the maintenance of old cash-desks or counters.

In addition, these devices require considerable drive means which must also be, generally, installed at the internal part of the counter or cash-desk.

It is an object of the present invention to overcome these drawbacks and to provide a protective device against aggressions which permits, if desired, the maintenance of existing cash-desks or counters and which is, moreover, capable of being adapted to very different heights with the minimum of changes, these various qualities enabling a device according to the invention to have a cost price and an installation price which is particularly low.

According to the invention there is provided a protective device against aggressions of the type comprising, at the lower part, a tray or cash-desk surmounted by a free space without obstacle to passage therethrough, and means permitting the rapid closure, from below upwards of said space arranged above the tray, characterised by the fact that said closure means comprise at least one bullet-proof portion of the tray, said portion being movable from a lowered position in which it is substantially horizontal to a raised position in which it blocks the space preventing passage therethrough and protecting it against bullets.

Preferably, the tray, or said tray portion, is formed by several elements articulated one after the other or separately, on horizontal axles, the various elements becoming arranged one after the other when they are brought into vertical or oblique raised position to block the space situated above the counter or cash-desk.

Advantageously, said tray or said tray portion may, in their lowered position, be simply arranged on the upper portion of the cash-desk or counter, resting on this upper portion or being suspended at a short distance from the latter.

The drive means which can bring said movable tray or said movable portion of tray rapidly into position may be incorporated beneath the tray in the cash-desk or counter. However, in a particularly preferred embodiment of the invention, these means may be arranged above the tray or even spaced at a distance so as to draw the movable tray or said portion of tray upwards.

These means may be of any nature, notably may include pneumatic or hydraulic jacks, springs, counterweights, electric motors or the like, with which a counterweight may advantageously be associated to reduce the necessary driving force. It is particularly preferable for the drive means to be applicable to the movable tray or the movable tray portion by means of chains or cables arranged laterally and which can exert a tractive force upwards. These chains or cables may be, if necessary, brought back to the level of the ceiling above the cash-desk, to active drive means or even means simply constituted by a suddenly released counterweight. In this way, by a suitable set of chains or cables, the same drive means can also actuate a plurality of devices according to the invention.

In a particular embodiment of the invention, the cash-desk tray may be composed of four elements arranged in pairs symmetrically with respect to the middle plane of the device, each element covering the shape of a flat plate, namely, on each side of the device, a lower plate articulated to an axle fixed on its edge close to the central portion of the device and articulated through its opposite edge to the plate forming the higher element, itself articulated in the middle plane to the homologous element on the other side of the middle plane. These elements in the form of plates thus form a sort of articulated quadrilateral capable, in lowered position, of exhibiting a tray surface formed by two upper elements and, on a thrust or traction upwards, of forming a substantially vertical double wall extending from the level of the tray up to the upper part of the device.

If necessary, a protective padding may be provided at the level of the outer articulations and of the upper articulations.

As a modification, it would be possible, in a similar configuration, for the tray to have only two elements, namely a lower element and an upper element, arranged, for example, on the side of the employee, the tray part arranged on the customer side, being fixed. However, it would also be possible to envisage an entirely movable tray constituted only by two elements of greater width, the upper element being, for example, driven upwards, preferably, at the level of the central parts of its extreme edges.

In another particular embodiment, the movable tray, or the movable tray portion, may be composed of a larger number of articulated plates becoming positioned, in the lower tray position, for example, in the manner of an accordeon or an extendable pantograph. Preferably the movable portion can only occupy the central portion of the tray whose edges are then fixed.

In the raised blocking position, the one or more elements forming the movable tray portion or the movable tray may extend, in a substantially vertical direction, preferably in the central part of the cash-desk, that is to say in its middle plane, or on the contrary, as a modification, obliquely. In this case, it is possible, for example, to provide for the tray to include, to form its upper surface, two flat elements, symmetrical, with respect to the middle plane, and articulated on a fixed base at one edge, one close to the public, and the other, to the employee, like a door with two flaps, these two elements covering, in lowered position, a plurality of other elements, for example two in number, articulated together through their adjacent edges in the middle plane, so as to form, under the effect of a thrust or of a traction upwards, a dihedral angle, for example under the action of their own weight, each wing of the dihedral angle lifting, on its reascent, one of the upper elements whilst the dihedral emerges upwards opening in a way this door with two flaps, the elements thus being arranged following one another to form, on both sides of the median plane, two oblique surfaces.

Means are advantageously provided to prevent an opening movement of the upper elements beyond the final inclined position as well as to ensure the maintenance of the dihedral in the open state.

In another particular embodiment, the tray may be composed of two or several elements capable of passing from the horizontal position to a vertical or oblique position following one other, each element being drawn, without being articulated to the following one, by the movement of an adjacent element or by drive means which are adapted to it, with suitable synchronisation between the movement of the various elements.

In a preferred embodiment, each device according to the invention may have, on each side of the tray and at the two extreme edges of the latter, two lateral uprights capable, for example, of containing and camouflaging the traction member such as, for example, a chain or a cable. These elements may also bear, if necessary guide slideways, it being understood that, in certain embodiments of the invention at least, it is possible, by simple kinematic arrangement of the articulations to ensure positioning without the presence of lateral guide elements.

In such a particularly preferred embodiment, the device according to the invention comprises a structure formed by two lateral uprights suspended from the ceiling if necessary and preferably an upper element extending between the two trays for example in the form of a fan-light, which may advantageously be telescopic for adaptation to the desired height of the tray, containing drive means or a portion of the latter, such as, for example, cables, and bearing those articulation axles which are fixed.

Thus, the suspended portion, with its movable tray, is entirely independent of the counter or cash-desk itself and can simply be lowered from the tray above the latter or rest on the latter. It is conceived that, in this way, it is possible, due to the invention, without modification, of being adapted to any tray or cash-desk height and even to use already existing cash-desks, the devices according to the invention becoming simply arranged above the latter.

However, it is self-evident that it is possible also, although this may be less advantageous, to provide drive means beneath the tray in order to exert on the latter, either a tractive force upwards by a return means arranged at the upper part of the device, notably uprights, or a downward thrust.

Other advantages and characteristics of the invention will be apparent on reading the following description, given by way of non-limiting example, with reference to the accompanying drawing in which:

FIG. 4 shows a diagrammatic view in elevation of a set of devices according to the invention.

FIGS. 5*a*–5*d* shows several diagrams of drive means for the device according to the invention.

Figure 6:
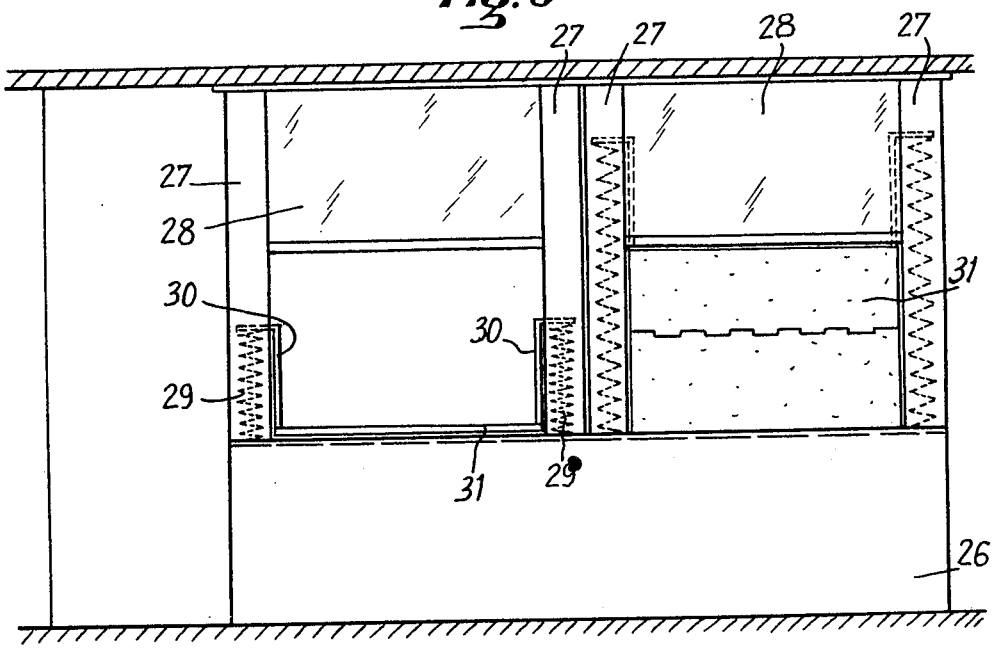

FIG. 6 shows a view of a device driven by springs.

Figure 7:
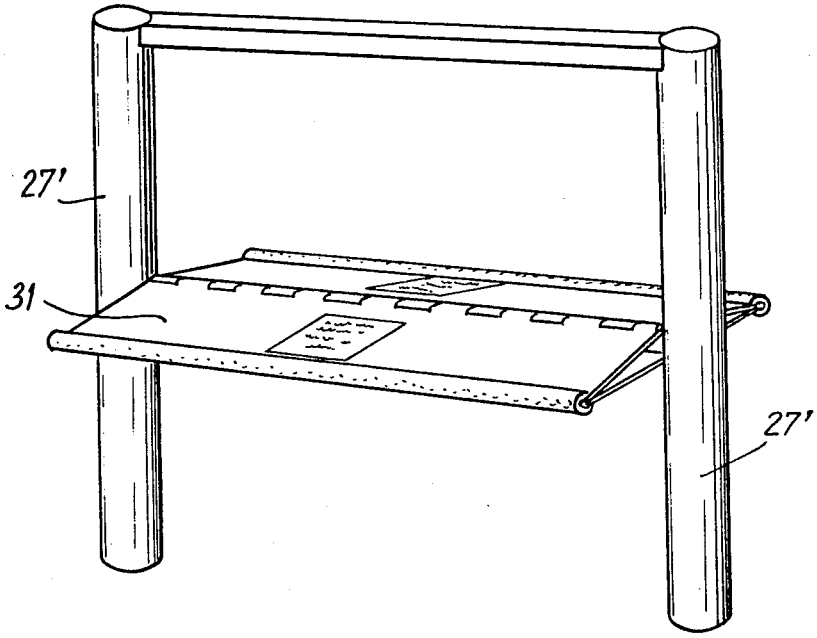

FIG. 7 shows a perspective view of a device according to a modification of the embodiment of FIG. 6.

Figure 8A:
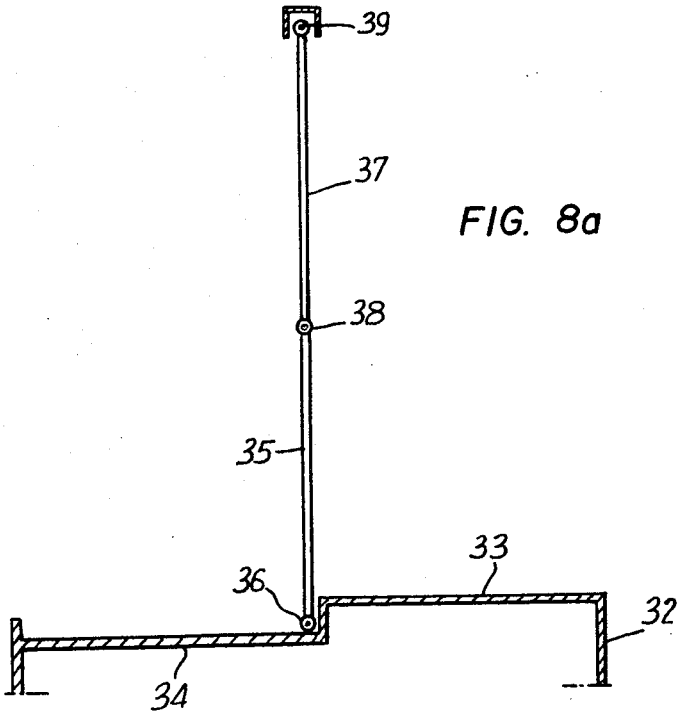
Figure 8B:
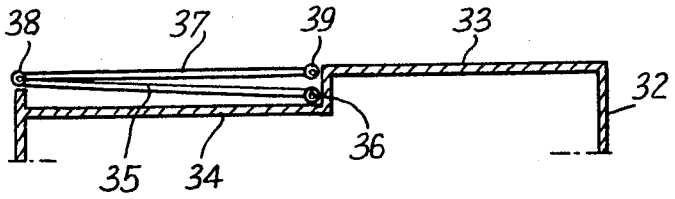

FIGS. 8*a* and 8*b* shows diagrams of a part of a table of a device according to another modification of the invention.

Figure 9:
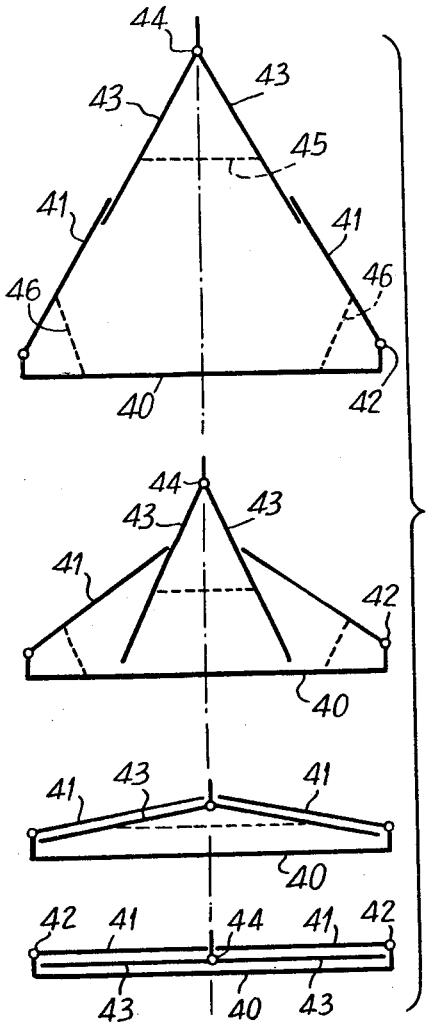

FIG. 9 shows diagrams of a table of a device according to another modification of the invention during its different phases of movement.

Figure 10:
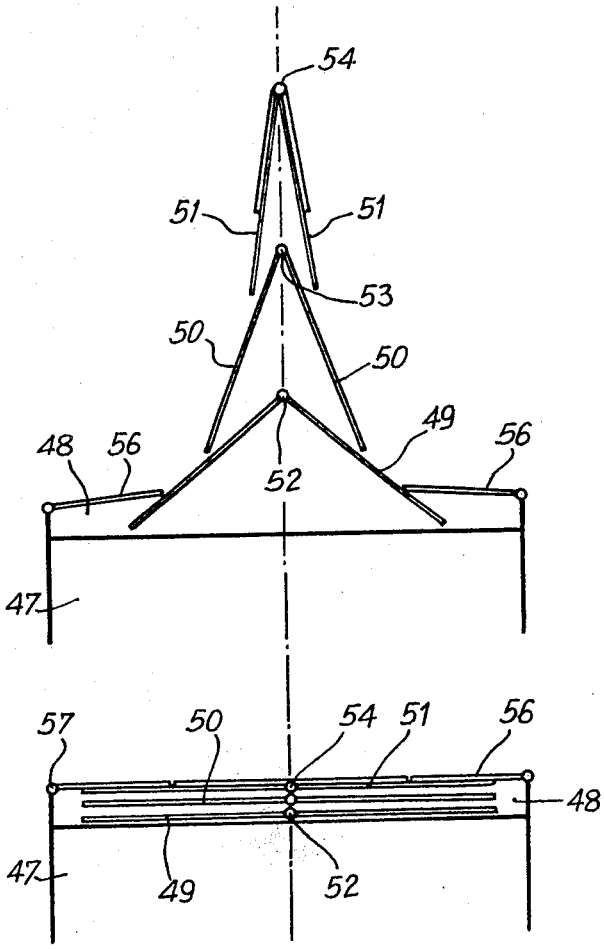
Figure 11:
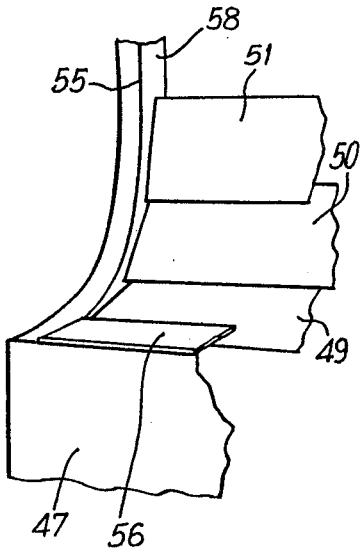

FIGS. 10 and 11 show diagrams of another modification of the invention.

Figure 12:
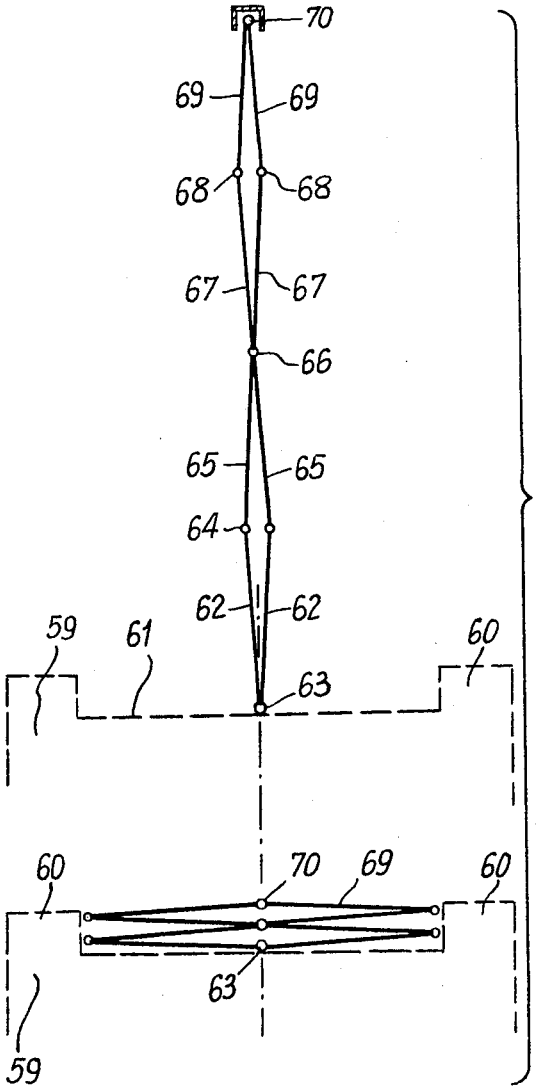

FIG. 12 shows diagrams of a table according to another modification in lowered and raised positions.

Figure 1:
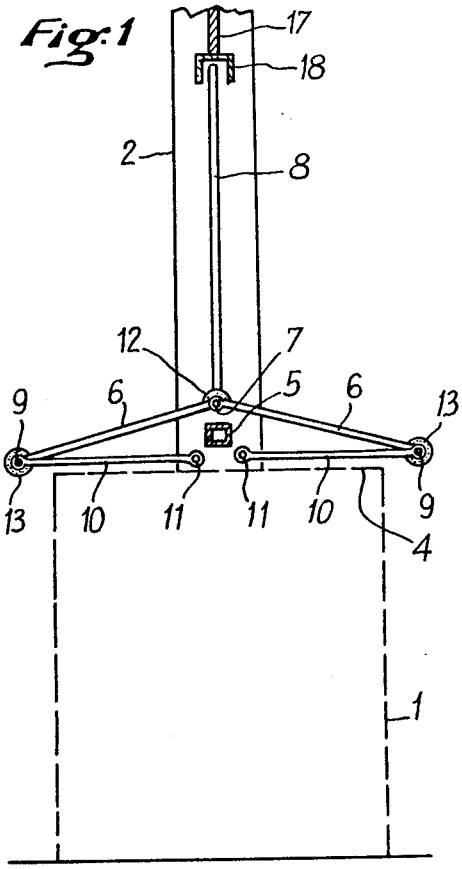
FIG. 1 shows a cross-sectional view of a device according to one embodiment of the invention, with its tray in lowered position.
Figure 2:
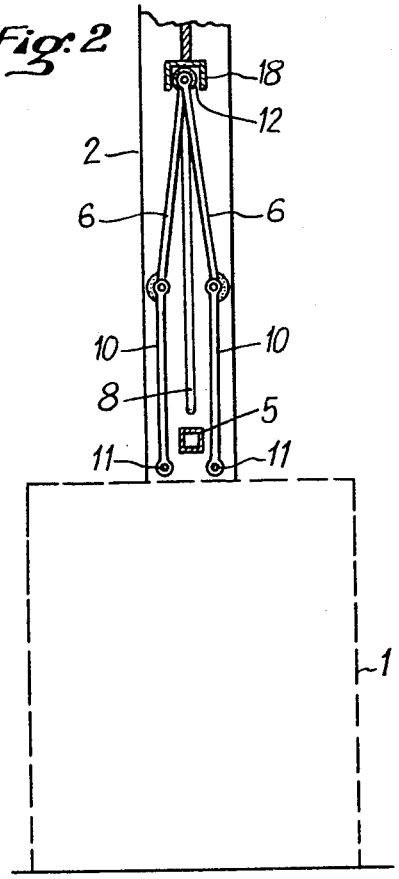
FIG. 2 shows a sectional view of this device with its tray raised.
Figure 3:
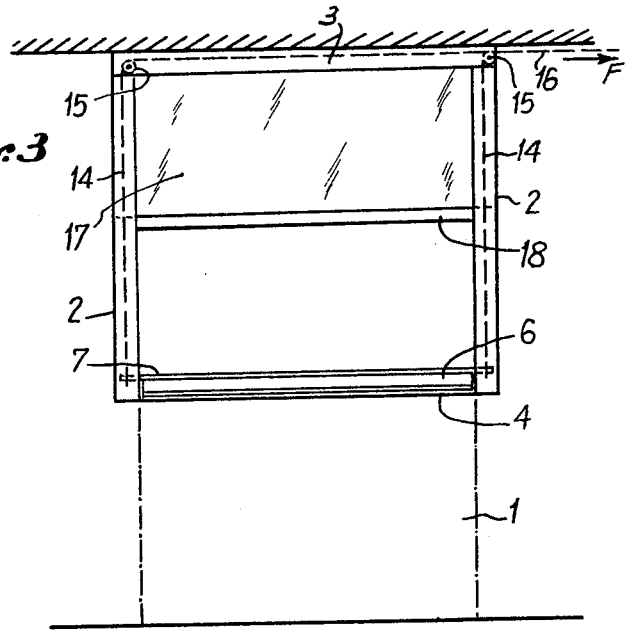
FIG. 3 shows a view in elevation of this device with its tray raised.

Reference is made to FIGS. 1 to 3.

The device according to the invention includes, above a counter 1 shown diagrammatically, two metallic profiled elements, for example tubes with a rectangular cross-section 2, extending vertically downwards from a transverse metal profile 3 fixed to the ceiling. The lower ends of the profiled elements 2 become positioned at the level of the upper surface 4 of the counter proper 1. These ends may be fixed against the counter in any manner, for example, by screwing, by means of brackets (not shown), so that the profiled elements 2 remain held rigidly in their vertical position. This rigidity may also be ensured by a weaker square section profiled element 5, shown in FIGS. 1 and 2, and extending between the uprights 2 at the lower portion of the latter.

The working table of the counter is formed from two armored metal plates 6 articulated around a common horizontal axle 7, extending in the median plane of the cash-desk, said axle being guided at both ends, which pass slightly beyond the plates 6, in two guide grooves 8 formed in the uprights 2. To this end, the two ends of the axle 7 may if necessary each bear a small guide part, for example of plastics material, slidable in the groove 8. From the common axle 7, the two plates 6 extend slightly obliquely downwards, on both sides of the median plane as is seen in FIG. 1. At their extreme edges, arranged one on the public side, the other on the employee side, the plates 6 are articulated by horizontal parallel axles 9 on lower armored plates 10 which, in the lowered position shown in FIG. 1, rest on the upper surface 4 of the counter, each being articulated around a fixed horizontal axle 11 whose ends are borne by the lower portion of the upright sectional elements 2. In the drawing, two axles 11 are seen located at a small distance from one another and close to the median plane of the device; it would also be possible to provide a single axle which would be common to the two adjacent plates 10.

It is seen also that the articulations 7 and 9 are covered with pads of synthetic foam 12, 13, designed both to mask the articulations and to ensure protection against shock. In addition, the pads 13, borne by the articulations 9, can form a stop preventing the sliding of documents which would be deposited on the upper armored plates 6. The latter can, advantageously, be covered with a decorative coating, for example of artificial leather.

As is seen in FIG. 3, two parallel cables 14 are capable of running in the uprights 2, the ends of said cables 14 being fixed to the two ends of the articulation axle 7 which penetrates, after having passed through the grooves 8, to the profiled elements of the upright. These cables 14 are sent back at the level of the upper profiled element 3 by pulleys 15 to end in a single or common cable 16 leading in the direction of extension of the beam 3. The cable 16 ends itself in a drive means capable of carrying out a tractive force which is powerful and rapid in the direction of the arrow F.

The operation is as follows:

In the lowered state, the device adopts the position shown in FIG. 1 and in FIG. 3, in which position the two plates 6 form the working tray of the cash-desk, one on the customer side, the other on the employee side, this working tray completely masking the upper face 4 of the counter proper since, in the embodiment shown, the articulations 9 are arranged well beyond the lateral surfaces of the counter. Preferably, the distance between the two articulations 9 is of the order of 1 meter, the height of the articulations 9 above the floor being 110 to 130 cm.

In the case of a threat or an attack, the employee actuates, by hand or by foot, an ordinary actuating device which then immediately places the drive means in operation. The latter exert a vigorous and rapid tractive force on the cable 16, which causes the immediate rise of the articulation axle 7, guided in the grooves, causing the deformation of the parallelogram or quadrilateral formed by the four plates 6 and 10, which then rapidly take up the substantially vertical position shown in FIG. 2 where these plates close and completely mask the space situated above the cash-desk 1 and below a panel 17 positioned between the uprights 2 at the upper part of the latter.

Advantageously, the foam pad 12 may, at the end of this movement, be received in an inverted U-shaped sectional member 18 located beneath the panel 17. This sectional member may be internally coated with damping means or the padding 12 may itself act as a shock-absorber when it strikes the bottom of the sectional member 18.

Referring to FIG. 4, it is seen how a certain number of devices according to the invention may be positioned one beside the other. In this case, the multiple device obtained comprises a beam or sectional member 3 fixed to the lower surface of the ceiling and, from this beam 3, a plurality of parallel uprights extending downwards above the counters 1. The various cables 14 all converge to a common cable 16′ running inside the beam 3 and capable of receiving the action of the drive means.

Referring to the various diagrams of FIGS. 5*a*–5*d*, various drive means shown diagrammatically are seen. Thus, referring to FIG. 5*a*, by way of example, the end of the cable 16 may be guided around the pulley 17′, borne by the rod of a jack 18′, to be sent back to a fixed point 19. The actuation of this jack, which passes from the resting position shown in full line to the active position shown in dashed line, results in the movement of the cable 16 in the direction of the arrow F. It is possible, in addition, to associate with this jack an opposing spring 20 tending spontaneously to pull the cable 16 in the direction of the arrow F, but whose power remains however insufficient to cause the passage, by itself alone, of the tray from the lowered position to the raised closing position. However, the presence of this spring enables the speed of ascent of the articulated tray to be increased during the most critical initial phase.

FIG. 5*b* shows the cooperation of the jack 18′ analogous to the preceding jack with a counterweight 21 tending also to spontaneously advance the cable 16 in the direction of the arrow F, this counterweight, like the spring 20, not however being sufficient to cause by itself alone the lifting of the tray.

FIG. 5*c* shows that the cable 16 is fixed, by its end, to a guided plate 22 slidable downwards, under the effect of a tightened spring 23 of high power decompressable to reach the position shown in dashed line, causing sudden traction in the direction of the arrow F on the cable 16.

FIG. 5*d* shows the cable 16 provided at its end with a simple counterweight 24, locking means 25 being provided. When these locking means are released, the counterweight 24 falls under the effect of gravity causing the advance of the cable 16 in the direction of the arrow F.

Of course, other drive means may be used arranged suitably for the technician skilled in the art, such as electric motors or combinations of the various drive means described.

In addition, as a modification, instead of acting on a common cable 16, it would be possible to act in any other way on the tray to cause its lifting. In particular, it is also possible to envisage, even if this has drawbacks, the arrangement of the drive means not away from the devices proper, but for example, within the counter 1.

Thus, referring to FIG. 6, a device is seen including a counter 26 similar to the counter 1, but of great length. This counter 26 is surmounted by four vertical uprights 27, similar to the uprights 2 and defining, in fact, two cash-booths surmounted by panels 28. Within each upright 27 are compressed long springs 29 capable of acting through return pulleys, cables or rods 30 on an articulated tray 31 similar to that shown in the preceding Figures. By suitable control means, for example of the electromagnetic type or simply catches, it is possible to release the springs which, from the compressed position shown in the left-hand cash-booth of the Figure, then pass rapidly into the uncompressed position shown in the right-hand cash-booth, in which position they have driven the plates of the table 31 into blocking position. Referring to FIG. 7, a device according to another modification is shown comprising this time tubular posts, for example circular 27′, similar to the uprights 27, these posts extending this time just to the floor. Within these posts are arranged springs similar to the springs 29, and capable of driving the tray 31 rapidly from its lowered position shown in FIG. 7, to a position in which it closes the space situated above it. In such an embodiment, it is unnecessary to provide a fixing to the ceiling in the form of a horizontal beam such as the beam 3. It may be noted that this arrangement also permits, notably if means are provided for adjusting the position of the height of the tray 31, the use of existing counters which are located beneath the tray 31 between the uprights 27'.

In order to recompress the springs, after operation, it is possible to provide any manual, mechanical or electrical means.

Reference is now made to FIGS. 8*a* and 8*b*.

In these Figures there is shown, extremely diagrammatically, a counter 32 whose upper surface has, preferably on the customer's side, a fixed tray portion 33 followed, on the employee's side, by a portion 34 offset downward. On this offset portion, is found a lower plate 35, similar to the plate 10, articulated at its edge close to the central portion on a horizontal axle 36, similar to the axle 11, and an upper plate 37, similar to the plate 6, but resting in a horizontal position in continuity with the surface 33, the plates 35 and 37 being articulated at their common extreme edges at 38. In FIG. 8*b* is shown the lowered position and in FIG. 8*a* the raised position in which the two plates 35 and 37 are in vertical extension of one another. As in the case of the preceding device, the other edge 39 of the plate 37 is guided suitably, for example in a groove similar to the groove 8, and it is preferably this edge which, by its guided ends, receives the thrust or the traction of the drive means.

In this arrangement, the tray is constituted by the surface 33 and the surface of the plate 37, so that only a portion of the tray, situated preferably on the employee's side, is movable.

Referring to the different diagrams of FIG. 9, the various stages of development are seen on the ascent of a tray, comprising a lower horizontal base 40 fixed at the two extreme edges, on the customer's side and employee's side, to which are articulated two plates 41, by means of articulations 42 borne by the plate 40. The plates 41, which may be opened like the flaps of a double door, rest by simple gravity on two plates 43 hinged on their middle common edges around an axle 44 similar to the axle of the articulation 7. The two ends of the axle 44 thus are guided in uprights, for example by means of grooves such as the grooves 8. In the resting state, the plates 43 rest by gravity on the bottom plate 40. When a traction is effected on the articulation 44 upwards, the flat angle formed by the plates 43 is gradually converted into a dihedral angle whose lower limiting value may be determined by abutment means diagrammatically shown at 45 and preventing further approach of the plates 43 toward one another. This dihedral is formed by raising the articulated plates 41 and the final position obtained shows that the tray is deformed into a dihedral whose two sides are formed by the plates 43, extended downwards by the plates 41 situated in alignment. Stop means 46 may be provided to prevent a further opening of the plates 41.

Of course, various means such as small rollers may be borne by the plates so as to facilitate the sliding of the plates on one another.

Referring to FIGS. 10 and 11, there is seen a modification of the invention in which the upper portion of a counter 47 possesses a reinforcement 48 in which are positioned, in the lower state, three sets of plates 49, 50, 51. Two plates of each set, which extend over a distance less than one half the width of the counter, are articulated around a central horizontal axle, namely 52, 53, 54, whose two overlapping ends are guided in vertical grooves formed in the uprights 55 in the manner of the grooves 8. By suitable means, cables or rigid rods sliding in the uprights 55, the axle 54 is first drawn upwards, then the axle 53 and lastly the axle 52 so that, on ascent, the three sets of plates form three dihedrals of downwardly increasing angle, as is seen in FIG. 10. At the end of the ascent, the angles of the three dihedrals are at their minimum and the plates 49, 50, 51 are close to the vertical.

The device may also include two flaps 56 articulated on the edges 57 of the counter 47 and whose width is such, that according to the incurved path of the plates on their ascent, the flaps 56 are slightly separated from the horizontal, limiting the risks of fall or projection of papers or objects placed on the counter before the closing.

Advantageously, the uprights 55 may have a curved shape flaring downwards, as in seen in FIG. 11, so that at any moment, the extreme edges of the plates are always arranged against the opposite surfaces 58 of the uprights, thus preventing access at these extreme edges.

Locking means (not shown) may be provided in the uprights so that in raised position it is not possible to open the three dihedrals 49, 50, 51 from the outside.

Of course, it is also possible to replace each dihedral by a single plate, which would permit elminating in the drawing the plate 49, 50 and 51 on the right, preferably from the employee's side.

Referring to FIG. 12, there is seen a counter 59 whose upper part 60 possesses a central depression 61 into which may be withdrawn, in the lowered state, a movable tray portion comprising, from the bottom, two armored plates 62 articulated at a middle lower fixed point 63 and each having approximately a width equal to half the width of the depression 61, to which plates are respectively articulated through hinges 64, two plates 65 hinged together, on their upper edges, at 66 and followed, from this hinge 66 by two similar plates 67 hinged at 68 to two plates 69 hinged on a common axle 70 similar to the axle 7 and guided like it on being subjected to upward traction means. There are thus obtained two consecutive articulated parallelograms in the manner of a pantograph which, in folded position, are arranged in the depression 61 in continuity with the surface 60 to form a tray portion and which, on the contrary, in raised position, form an armored wall closing the passage above the counter.

The drive means may be of any type, for example similar to those used for driving the tray shown in the FIGS. 1 and 2.

Preferably, the vertical uprights, such as the uprights 2, 27 or the uprights, not shown, designed to guide the elements of other movable trays, are fixed to the ceiling or to a structure close to the ceiling, to be extended downward, stopping at the level of the upper surface of the counter. Preferably, these uprights are constructed in several telescopic parts, so as to permit an instantaneous adjustment in height rendering the device adaptable to any particular situation.

In addition, the upper panel, when it exists, instead of being constructed in fixed manner, like the panel 17 of FIG. 1, could be constructed movably to descend downwards, against the movable tray or the movable tray portion, which permits, if desired, reduction in the vertical distance which must be closed by the tray. For example, in FIG. 12, the tray could only include the plates 62, 65 articulated as a parallelogram, the parallelogram formed by the plates 67, 69 then being omitted and replaced by a similar parallelogram whose upper axle, replacing the axle 70, would then be fixed to the ceiling. The two independent parallelograms would then be directed towards one another during the closing operation.

The counter proper may already preexist before the installation of the device according to the invention. It must then be provided with a vertical armored plate. If, on the contrary, the counter is placed in position with the device, it can advantageously be constructed of sheet metal folded or welded not necessitating any special armoring.

It is also possible, beneath the plate in lowered position, instead of a more or less conventional or preexisting counter, to close the space situated beneath the tray, in any manner, by a fixed armored plate, the connection between this fixed lower portion and the tray guiding uprights being effected in any manner available to the technician skilled in the art.

Preferably, the overall width of the tray of the counter is of the order of one meter, the movable portion coming to close the space arranged substantially at the middle.

In the majority of the embodiments shown, it is seen that each portion of the space situated above the counter is closed by two plates, for example, the two plates 6, 41, 50, 62. This permits a reduction in the thickness of each plate, whilst increasing the efficiency. In addition, certain of the embodiments enable the closing to be ensured with one or several oblique plates, again increasing the effectiveness of the armour.

Although the invention has been described with regard to particular embodiments, various modifications may be applied thereto without departing however either from the scope or the spirit of the invention.

I claim:

1. A protective device for preventing aggressions, comprising:

a counter surmounted by an open space allowing free passage of a person across the counter, closing means for rapidly closing the open space upwardly from below the counter, said closing means comprising a bullet-proof portion of a tray forming at least a part of an upper side of said counter, powerful driving means for rapidly driving said portion from a lowered position, in which it is substantially horizontal, to a raised position in which it closes said space to totally prevent passage therethrough, and thereby protect said space against bullets, wherein said portion of the tray is formed of several elements articulated separately around horizontal axles, said elements becoming arranged one after the other, seen in the vertical direction, when they are brought into raised position to close said space so that two consecutive elements, seen in the vertical direction, are not articulated on a common horizontal axle.

2. A device according to claim 1, wherein at least a major portion of said tray is movable from said lowered position to said raised position.

3. A device according to claim 1, comprising means for ensuring the holding and the rigidity of said portion of the tray in the raised position.

4. A device according to claim 1, wherein said portion of the tray is constituted symmetrically with respect to a longitudinal median plane of the device.

5. A device according to claim 1, wherein said portion of the tray is constituted symmetrically with respect to a longitudinal median plane of the device.

6. A device according to claim 1, wherein said portion of the tray is, in the lowered position, arranged on the upper portion of the counter.

7. A protective device according to claim 1, comprising means carried by adjacent plates for facilitating a sliding motion of one plate on the other.

8. A protective device according to claim 1, comprising a plurality of initially horizontal and superimposed plates including an upper plate and a lower plate, each plate being articulated around a horizontal axle situated in a central portion of the counter, means positioned to receive the axles and guide the plates during the vertical raising movement, such that the plates form with the vertical, during the raising movement, angles that increase downwardly, so that the upper plate, upon completion of the raising movement is closest to the vertical in order to close an upper portion of the space, the lower plate closing a lower portion of the space.

9. A protective device according to claim 8, including two sets of symmetric plates.

10. A protective device according to claim 8, comprising means carried by adjacent plates for facilitating a sliding motion of one plate on the other.

11. A protective device according to claim 8, wherein in the lowered position the plates are contained in recesses of the counter.

12. A protective device, for preventing aggressions, comprising:

a counter surmounted by an open space allowing free passage of a person across the counter, closing means for rapidly closing the open space upwardly from below the counter, said closing means comprising a bullet-proof portion of a tray forming at least a part of an upper side of said counter, powerful driving means for rapidly driving said portion from a lowered position, in which it is substantially horizontal, to a raised position in which it closes said space to totally prevent passage therethrough, and therby protect said space against bullets wherein said portion of the tray, is composed of at least two elements capable of passing from the horizontal position to a raised, at least partially vertical position, one after the other, each element being driven, without being articulated on a fixed point to the following one.

13. A device according to claim 12, comprising on each side of the tray, at two extreme edges of the tray two lateral uprights which comprise means for containing and concealing tray actuating members.

14. A device according to claim 13, wherein said lateral uprights are suspended from the ceiling, extending downwardly, and support said tray in suspension.

15. A device according to claim 13, wherein said lateral uprights are formed of telescopic elements enabling their adjustment in height.

16. A device according to claim 12, comprising on both sides of the tray and at the two extreme edges of the tray, two lateral uprights comprising guide means for certain portions of the tray.

17. A device according to claim 16, wherein said lateral uprights are suspended from the ceiling, extending downwardly, and support said tray in suspension.

18. A device according to claim 16, wherein said lateral uprights are formed of telescopic elements enabling their adjustment in height.

19. A device according to claim 12, wherein the raising of an element causes the raising of the consecutive element.

20. A device according to claim 12, wherein at least a major portion of said tray is movable from said lowered position to said raised position, and wherein the raising of an element causes the raising of the next consecutive element.

21. A device according to claim 12, comprising, to form said portion of the tray, a base on the two edges of which are articulated two flap-forming plates, by the side of which are arranged two free plates articulated at their adjacent median edges, so as to form, under the effect of upward traction, a dihedral angle whose sides lift said flap-forming plates.

22. A device according to claim 12, comprising several sets of two plates, articulated independently as several dihedral angles, said dihehral angles being stacked flat on one another in the lowered position and having their axles connected to drive means to be successively raised one after the other into the said raised closed position.

23. A device according to claim 12, comprising uprights flared outwardly, downwardly to prevent access to the extreme edges of the movable portion of the tray in the closed position of the tray.

24. A device according to claim 12, comprising means carried by adjacent elements to facilitate a sliding motion of one element on the other.

* * * * *